US007000259B2

(12) United States Patent
Matechen

(10) Patent No.: US 7,000,259 B2
(45) Date of Patent: Feb. 21, 2006

(54) SPORTS GLOVE WITH PADDING

(75) Inventor: John M. Matechen, Irwin, PA (US)

(73) Assignee: Impact Innovative Products, LLC, Manor, PA (US)

( * ) Notice: Subject to any disclaimer, the term of this patent is extended or adjusted under 35 U.S.C. 154(b) by 0 days.

(21) Appl. No.: 10/674,086

(22) Filed: Sep. 29, 2003

(65) Prior Publication Data

US 2005/0066411 A1 Mar. 31, 2005

(51) Int. Cl.
*A41D 19/00* (2006.01)

(52) U.S. Cl. ..... 2/161.1

(58) Field of Classification Search ..... 2/16, 2/20, 158, 159, 160, 161.1, 161.2, 161.6, 2/162, 163; 128/846, 879, 892; 602/21
See application file for complete search history.

(56) References Cited

U.S. PATENT DOCUMENTS

| | | | | | |
|---|---|---|---|---|---|
| 3,890,648 | A | * | 6/1975 | Beal | 2/20 |
| 4,272,849 | A | * | 6/1981 | Thurston et al. | 2/16 |
| 4,561,122 | A | * | 12/1985 | Stanley et al. | 2/20 |
| D287,904 | S | | 1/1987 | Pierce, Jr. | |
| D299,564 | S | | 1/1989 | Pierce, Jr. | |
| 5,067,175 | A | * | 11/1991 | Gold | 2/16 |
| 5,285,529 | A | * | 2/1994 | Arena | 2/20 |
| D387,504 | S | | 12/1997 | Robinette | |
| 5,697,104 | A | | 12/1997 | Welton | |
| 5,819,312 | A | * | 10/1998 | Snyder et al. | 2/16 |
| 5,898,938 | A | * | 5/1999 | Baylor et al. | 2/20 |
| 5,987,642 | A | * | 11/1999 | Webster | 2/19 |
| 6,052,827 | A | | 4/2000 | Widdemer | |
| 6,226,795 | B1 | * | 5/2001 | Winningham | 2/20 |
| 6,425,134 | B1 | * | 7/2002 | Huang | 2/20 |
| 6,701,529 | B1 | * | 3/2004 | Rhoades et al. | 2/2.5 |
| 6,721,960 | B1 | * | 4/2004 | Levesque et al. | 2/161.1 |
| 6,775,847 | B1 | * | 8/2004 | Terris et al. | 2/161.1 |
| 2004/0103465 | A1 | * | 6/2004 | Kleinert | 2/16 |
| 2004/0123372 | A1 | * | 7/2004 | Kleinert | 2/161.1 |

OTHER PUBLICATIONS

Internet Web Page for Palmgard products—4 pages, dated Jul. 29, 2003.
Advertisement for AliMed inc. entitled "AliMed® Our most popular Impact Mitts".

* cited by examiner

*Primary Examiner*—Gary L. Welch
(74) *Attorney, Agent, or Firm*—The Webb Law Firm

(57) ABSTRACT

A vibration dissipating sports glove for use in holding a bat while hitting a baseball having an energy-absorbing front pad between the index finger and the thumb. The glove also has a back padding covering the metacarpal portion of the hand and may furthermore have knuckle padding for covering the middle knuckle of each of the fingers. By using padding in a discriminate fashion, only in areas of the hand most vulnerable to impact and vibration, the glove maintains adequate flexibility and feel while, at the same time, protects the batter from bat-induced vibration and, furthermore, from pitched balls which may hit the batter's hand. Additionally, the front pad conforms between the batter's hand and the bat to provide to the batter a more secure grip upon the bat.

40 Claims, 4 Drawing Sheets

SPORTS GLOVE WITH PADDING

BACKGROUND OF THE INVENTION

1. Field of the Invention

The invention is generally directed to the design of gloves and, in particular, towards a sports glove which will dissipate the energy of vibration transmitted through a baseball bat to the hands of the batter. The glove may also shield the back of a batter's hand from the blunt-force impact of a pitched ball.

2. Description of Related Art

When an individual hits a hard baseball with a baseball bat, the impact of the baseball imparts vibration to the bat. If the baseball contacts the bat at its center of percussion (sweet spot), the vibration imparted to the bat is minimal. However, as the point of impact deviates from the center of percussion, the vibration imparted to the bat increases. This vibration is transmitted to the hands of a batter holding the bat. As a result, a ball which impacts the bat away from the center of percussion may impart sufficient vibration to the bat which, in turn, is transmitted to the hands of the batter, such that the batter feels a sudden sting which, on occasion, may be painful.

While it is entirely possible to wear a glove that is padded to dissipate the energy of such vibration, prior art gloves include so much padding that the bat may slightly shift within the batter's hands, the glove may not be sufficiently flexible because of the padding, and the thickness of the padding may cause the batter to lose the "feel" of the bat. Additionally, stiff and/or thick padding does not permit the glove to conform to the hand of the batter which further lessens the "feel" of the bat for the batter.

Therefore, there is a need for a sports glove designed specifically for holding a baseball bat which minimizes by dissipation the vibration imparted to the batter's hands from the bat while, at the same time, maximizes the flexibility and the "feel" of the bat.

Furthermore, it is not uncommon for a baseball player facing a high-speed pitch to be hit by the pitch and, more particularly, to be hit in the metacarpal region of the hand holding the bat. Because the hand is between the bat and the ball and because the bat has a relatively hard surface, the pain and injury inflicted to the player's hand may be significant from this blunt-force impact. However, gloves having a padded back have not been designed exclusively for baseball batters and other padded gloves that might provide protection to the back hand of the batter include excess padding which, once again, encumbers the flexibility of the batter and affects the "feel" of the bat by the batter. Therefore, a batting glove which provides protection to the batter's hands, but does not adversely affect flexibility and allows the batter to retain the "feel" of the bat, is also desired.

SUMMARY OF THE INVENTION

One embodiment of the subject invention is directed to a vibration dissipating sports glove for use in holding a bat while hitting a baseball, wherein portions of the glove correspond to bones in a wearer's hand to which the glove is intended to cover comprising:

a) a palm portion of the glove, for covering the inner surface of a wearer's hand, exclusive of the thumb;

b) a back portion of the glove for covering the outer surface of a wearer's hand, exclusive of the thumb;

c) a thumb portion of the glove for covering the wearer's thumb, wherein the thumb portion is coupled to the palm portion; and d) a vibration dissipating front pad in the palm portion extending only over and between the proximal knuckles of the thumb, index finger and middle finger and along adjacent portions of the metacarpal bones and proximal phalanges of each of these thumb and fingers respectively, leaving the remainder of the palm portion unpadded, wherein the energy of the vibration that may be transmitted to the wearer's hand at the time of impact of a baseball with a baseball bat is dissipated by the pad.

The glove may further include back padding at the back portion of the glove covering only the region defined by the metacarpal bones of the index finger, middle finger, ring finger and small finger.

The glove may also include a knuckle pad at the location of each the middle knuckles of each finger, excluding the thumb.

The glove may further include a wrist portion with a pad containing an energy dissipating comformable media.

The glove may also have padding only at the back portion of the glove.

Finally, the front pad of the glove may be used to conform between the bat and the batter's hand to allow the batter to have a more secure grip on the bat.

DETAILED DESCRIPTION OF THE INVENTION

Figure 1:
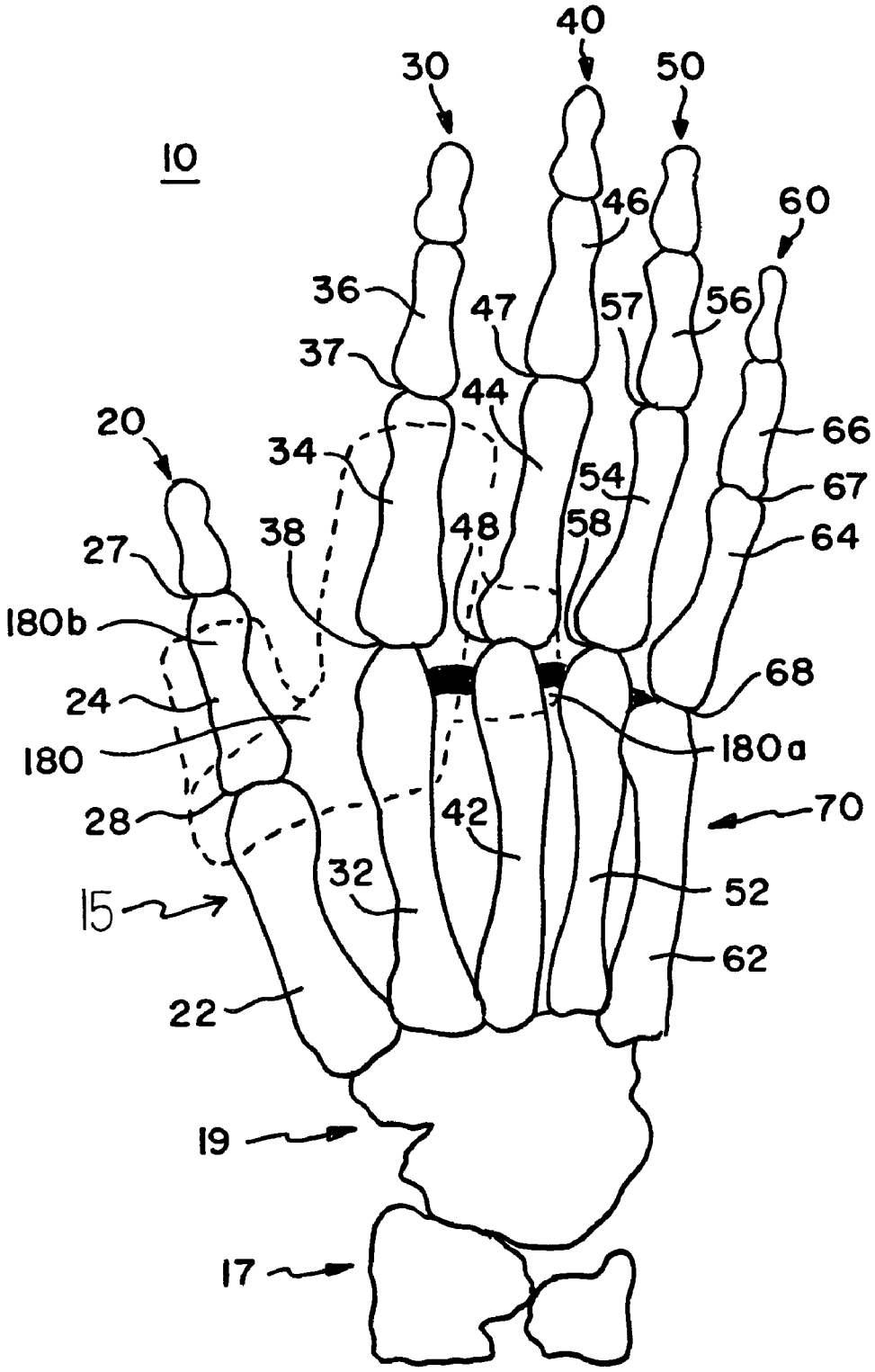
FIG. 1 is a sketch of a hand highlighting the bones therein.

FIG. 1 is a sketch of the bones of a human hand and elements of the sports glove in accordance with the subject invention will be described relative to the bones and the hand parts covered by the glove. A hand 10 includes a thumb 20, index FIG. 30, middle finger 40, ring finger 50, and small finger 60 extending from the metacarpal region 15 which is connected to the wrist 17. Extending from the wrist 17 is a cluster 19 of connecting bones and extending from this cluster 19 is the thumb metacarpal 22, the index finger metacarpal 32, the middle finger metacarpal 42, the ring finger metacarpal 52 and the small finger metacarpal 62. Any reference hereinafter to fingers will be directed to the index finger 30, the middle finger 40, the ring finger 50 and the small finger 60 to the exclusion of the thumb 20 for which separate reference will be made.

The distal ends of the metacarpal bones associated with the fingers are laterally secured to one another by tendons to define the metacarpal region 15. The inner surface of the metacarpal region 15 is generally referred to as the palm 70. Extending from the metacarpal bones of the fingers are the proximal phalanges 24, 34, 44, 54, 64 associated with the thumb 20, the index finger 30, middle finger 40, ring finger 50 and small finger 60, respectively. Extending from the distal ends of the proximal phalanges are the middle phalanges 36, 46, 56 and 66 of the index 30, middle finger 40, ring finger 50 and small finger 60, respectively. Directing attention to the index finger 30 between the proximal phalange 34 and the middle phalange 36 is a middle knuckle 37. A similar middle knuckle 47, 57, 67 is defined at the intersection of the middle phalange and proximal phalange of each of the middle finger 40, ring finger 50 and small finger 60, respectively. The thumb 20 has extending from the thumb metacarpal 22 a proximal phalange 24 with a proximal knuckle 28 therebetween. Additionally, opposite the proximal knuckle 28 on the proximal phalange 24, is a distal knuckle 27.

Sports gloves in accordance with the subject invention will be defined in general by the elements of a hand which fit within the sports glove and, furthermore, the elements of the hand will be defined by the bones of the hand.

Figure 2:
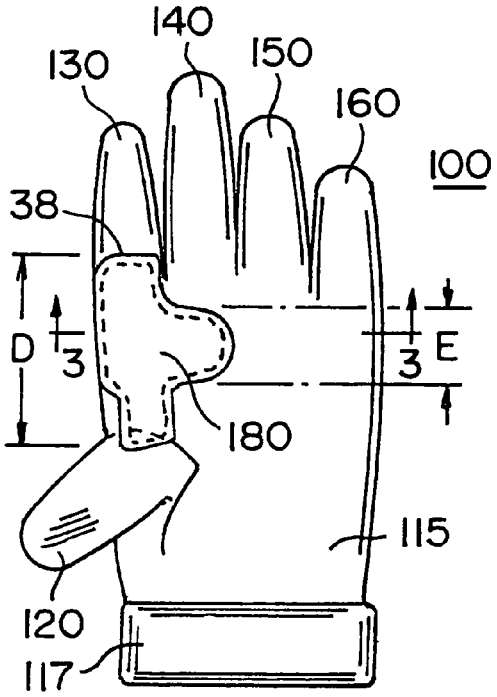
FIG. 2 is a first embodiment of the subject invention illustrating the palm portion of a glove with the vibration reducing pad extending to the middle finger.

FIG. 2 illustrates one embodiment of the subject invention. The sports glove includes a palm portion 115 extending from the wrist portion 117. Extending from the palm portion 115 is a thumb portion 120, an index finger portion 130, a middle finger portion 140, a ring finger portion 150 and a small finger portion 160. A back portion (not shown) of the glove covers the outer surface of the wearer's hand, exclusive of the thumb portion 120.

At the intersection of the metacarpal bones for each finger and thumb with the distal phalange of each finger and thumb is a proximal knuckle indicated by 28, 38, 48, 58 and 68 of thumb 20 and fingers 30, 40, 50 and 60, respectively (FIG. 1).

Figure 4:
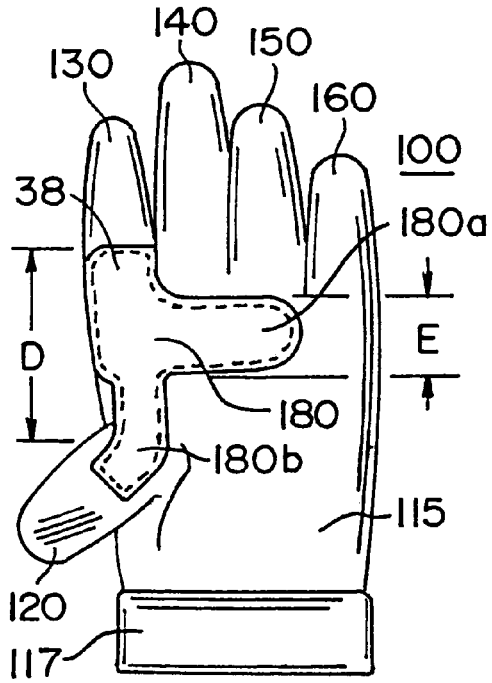
FIG. 4 is a variation of the embodiment illustrated in FIG. 2 with the vibration reducing pad extending to the ring finger and along the proximal phalange of the thumb.

A vibration reducing pad 180 (FIG. 2 but shown exaggerated in phantom in FIG. 1) in the palm portion 115 extends only over and between the proximal knuckles 28, 38, 48 (FIG. 1) of the thumb 20, index finger 30 and middle finger 40 and along adjacent portions of the metacarpal bones (22, 32, 42) and proximal phalanges of each of these thumb 20 and fingers 30, 40, respectively, leaving the remainder of the palm portion 115 unpadded such that a significant portion of the energy of the vibration transmitted to the wearer's hand at the time of impact of a baseball with a baseball bat is dissipated by the pad 180 while, at the same time, the remaining palm portion of the glove is unpadded and, therefore, flexible. The front pad 180 may extend along the index finger metacarpal bone 32, index finger proximal flange 34 and the thumb metacarpal bone 22 an index finger distance D. In doing so, the pad 180 covers the index finger proximal knuckle 38 and the thumb proximal knuckle 28. Furthermore, the front pad 180 may extend along the middle finger metacarpal bone 42 and proximal phalange 44 a middle finger distance E, thereby covering the middle finger proximal knuckle 48. The front pad 180 is generally "T" shaped. In another embodiment, illustrated in FIG. 4, the vibration reducing pad 180 may have an additional pad portion 180*a* which extends to the proximal knuckle 58 of the ring finger 50. The vibration reducing pad 180 may also have another additional pad portion 180*b* which extends along the proximal phalange 24 of the thumb 20 and terminates before reaching the distal knuckle 27.

Figure 3:
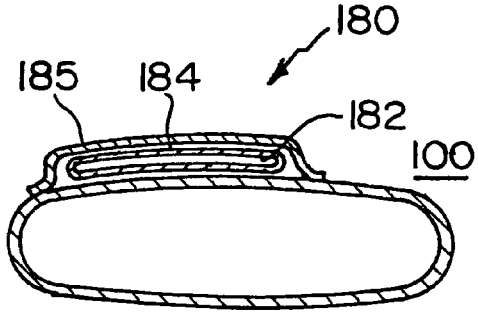
FIG. 3 is a cross-sectional view along arrow "3—3" in FIG. 2.

As illustrated in FIG. 3, the pad 180 may be comprised of energy dissipating conformable media 182, such as polyborosiloxane, encapsulated in a non-porous flexible sheath 184, such as PVC or polyurethane having a thickness of approximately 12 gauge. The encapsulated media is held in place against the glove 100 by a section of material 185, such as leather or synthetic leather, placed over the media 182 and encapsulating layer 184 and secured to the glove 100. This fabrication process is well known to those skilled in glove making. The layer 184 may, however, be vacuum formed.

The conformed nature of pad 180 has an additional advantage. When a batter grasps a bat, irregular surfaces and different densities present in the palm and fingers prevent the batters hand from gripping the bat with uniform contact over the palm and fingers. However, since the pad 180 is conforms between the batter's hand and the bat, at least in the area of the pad 180, the batter is better able to grip the bat with uniform contact, thereby resulting in a more secure grip.

Additionally, the glove 100 may be made of a flexible fabric material typically used for gloves, such as nylon or cotton. However, in a preferred embodiment, the glove material is nylon and the pad 180 is attached to the nylon.

Figure 5:
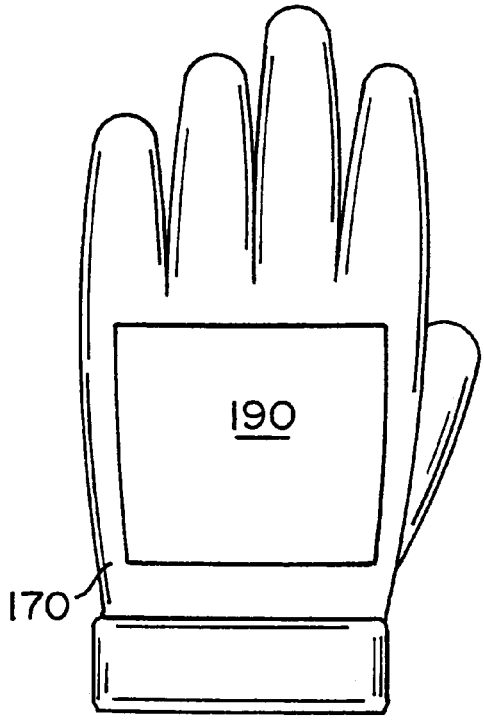
FIG. 5 is a second embodiment of the subject invention illustrating one embodiment of a back portion of a glove.

Directing attention to FIG. 5, a second embodiment of the subject invention further includes back padding 190 at the back portion 170 of the glove 100, whereby the back padding 190 covers only the region defined by the metacarpal bones of the fingers and, in particular, covers the index finger metacarpal bone 32, middle finger metacarpal bone 42, ring finger metacarpal bone 52 and small finger metacarpal bone 62 when the glove 100 is positioned upon the wearer's hand. The back padding 190 may be comprised of an energy dissipating conformable media encapsulated in a flexible layer. As an example, the media may be polyborosiloxane while the flexible layer may be PVC or polyurethane having a thickness of approximately 12 gauge. The back padding 190 may be comprised of a single flat pad, as illustrated in FIG. 5.

Figure 6:
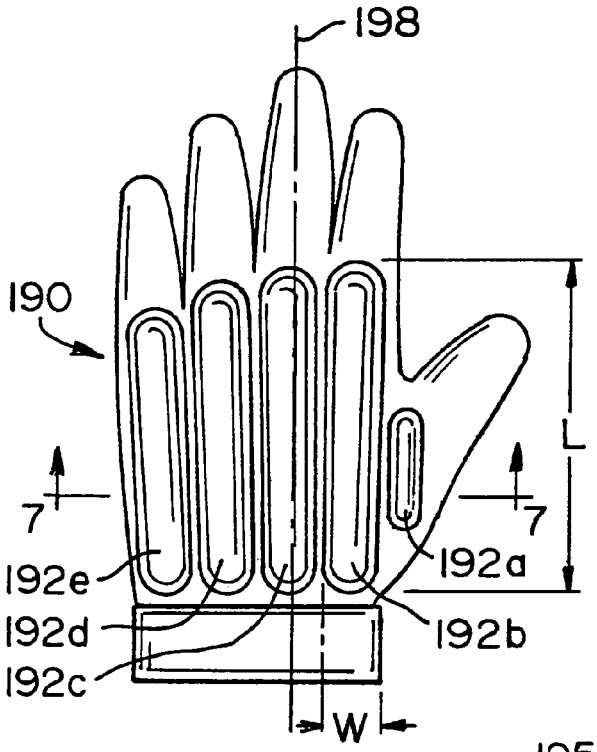
FIG. 6 is a third embodiment of the subject invention illustrating another embodiment of a back portion of a glove.
Figure 7:
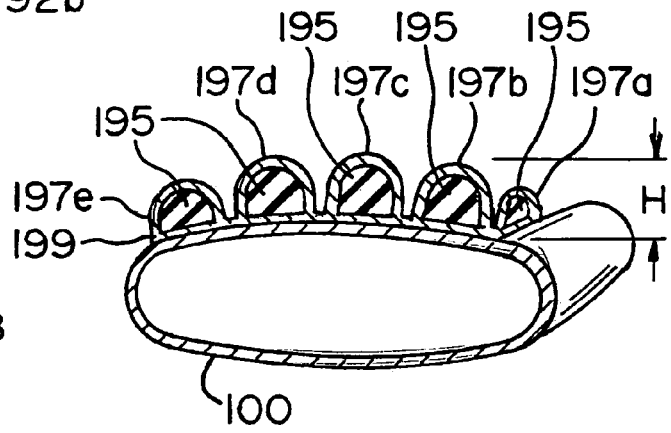
FIG. 7 is a cross-section along lines "7—7" in FIG. 6.

In the alternative, as illustrated in FIG. 6, the back padding 190 may be comprised of a plurality of discrete strips 192*a–e*, each containing an energy-dissipating conformable media. As illustrated in FIG. 7, each strip may be comprised of the energy dissipating conformable media 195 encapsulated in a plastic sheath 197*a–e* secured to the glove 100, either on top of the existing glove material or in place of the existing glove material. The energy dissipating conformable media may be, for example, polyborosiloxane, while the plastic sheath 197*a–e* may be a flexible layer of PVC or polyurethane having a thickness of approximately 12 gauge. The plastic sheath 197*a–e* may be mounted upon a flexible substrate 199 which would be secured to the glove 100. In the event the back padding 190 replaces the existing glove material, then it would be necessary to secure the back padding 190 to the material through such means as sewing or another positive attachment mechanism known to those skilled in the art of glove manufacturing. The strips 192*a–e* may be vacuum formed to provide a plurality of strips having a common substrate for the back padding 190. In such a fashion, the back padding 190 may be secured directly to the outside of a glove or may be secured to cover an opening in the back of the glove intended to receive the padding.

It is important that the plastic sheath 197*a–e* secured to the glove 100 is pliable enough to permit the conformable media 195 to deform and, therefore, dissipate the energy of impact. Therefore, the plastic sheath 197*a–e* may be a layer of polyurethane and, more particularly, may be a polyether aromatic polyurethane, such as Stevens Polyurethane ST-1880–87, provided by the Stevens Urethane Company. While this material is discussed with respect to sheath 197*a–e*, it should be appreciated that this material may be applicable to the sheaths for media in any of the embodiments discussed herein.

As illustrated in FIG. 6, each strip has a length L and a width W. For the embodiment illustrated in FIG. 6, the ratio between the length and width of at least one strip is between 0.7 and 1.5. Furthermore, directing attention to FIG. 7, each strip also has a height H and the ratio of the width-to-height for at least one strip is between 0.25 and 0.50. There are two families of strip thicknesses and the first family has now been described.

By utilizing strips as opposed to a single pad, the energy-dissipating conformable media is contained within certain regions predefined by the strips. To the extent the conformable media may flow to one segment or another of the single flat pad, or a plurality of very large strips, the proportioned strips in certain embodiments of the subject invention retain the flowable media within critical areas of the glove.

Figure 11:
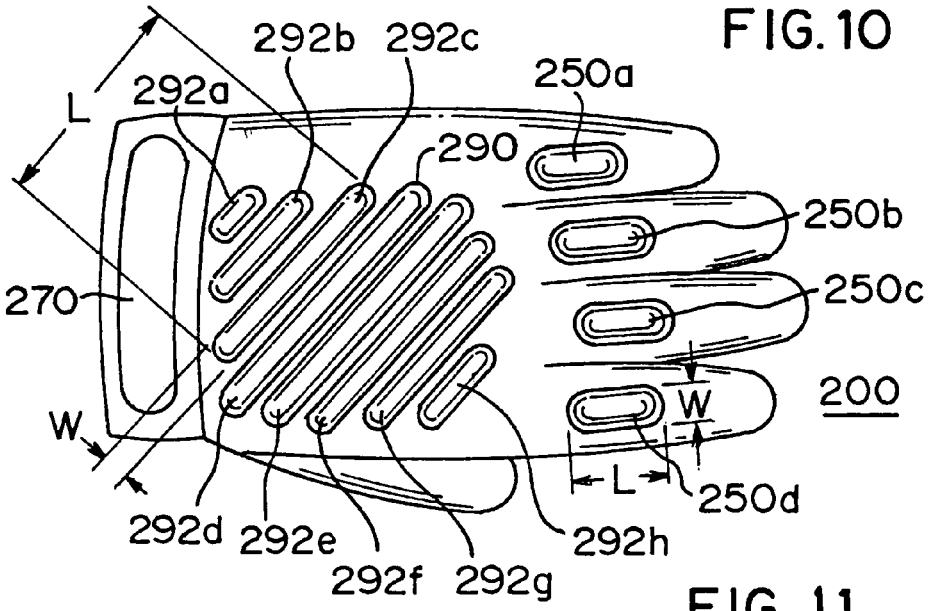
FIG. 11 is a seventh embodiment of the subject invention illustrating a back portion of a glove.

Briefly directing attention to FIG. 11, a glove 200 has the same features as those illustrated in FIG. 2 and, furthermore, has a back padding 290 with individual strips 292*a–h*. Each of these strips is thinner than those strips illustrated in FIG. 6 and, as a result, more strips may be used to form the back padding 290, thereby defining a second family of strip thicknesses. Just as before, each of these strips has a length L and a width W and, in a fashion similar to that illustrated in FIG. 7, a height H. For the glove illustrated in FIG. 11, the ratio between the length L and the width W of at least one strip is between 1.5–3.0. Furthermore, the ratio of the width W to the height H of the at least one strip is between 0.15 and 1.0.

Returning to FIG. 6, the glove 100 has a central axis 198 and the plurality of strips 192*a–e* are parallel to one and are aligned with the central axis 198. By providing discrete strips 192*a–e* aligned with the central axis 198, maximum flexibility is afforded to the wearer's hand. As an example, when a hand is laid flat upon a table, the proximal knuckles 38, 48, 58, 68 (FIG. 1) of the fingers 30, 40, 50, 60 align along the planar surface of the table. However, when the hand is formed into the shape of a fist, the proximal knuckles of the fingers now form an arch about a central axis which aligns with the central axis 198 of the glove. As a result, by aligning the plurality of strips 192*a–e* with the central axis 198, maximum flexibility is afforded to the hand of the wearer when grasping a bat. On the other hand, since the metacarpal bones move relative to one another to form the arch but do not themselves bend then with the strips 192*a–e* generally aligned with the metacarpal bones the strips do not need to flex in any other direction. To the extent, however, that each strip contains an energy-dissipating conformable media that itself is relatively flexible, it is possible to position the strips in an orientation different from that illustrated in FIG. 6.

Figure 8:
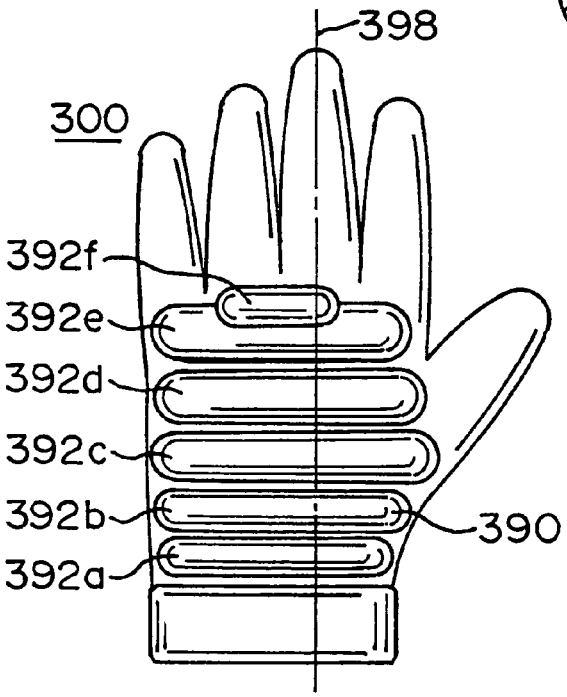
FIG. 8 is a fourth embodiment of the subject invention illustrating a back portion of a glove.

Directing attention to FIG. 8, a glove 300 has back padding 390 comprised of a plurality of strips 392*a–f* which are perpendicular to a central axis 398 extending through the glove 300.

Figure 9:
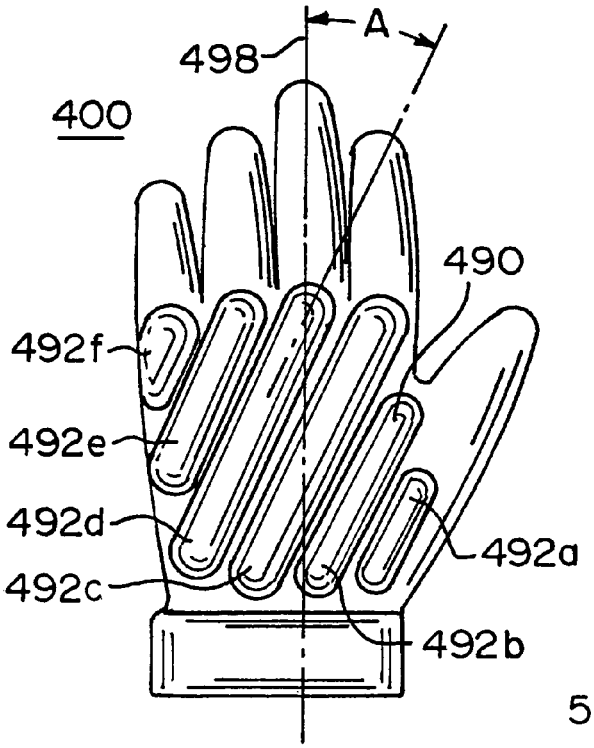
FIG. 9 is a fifth embodiment of the subject invention illustrating a back portion of a glove.

In yet another embodiment illustrated in FIG. 9, a glove 400 has a central axis 498 extending therethrough and a back padding 490 comprised of a plurality of strips 492*a–f*, wherein the plurality of strips a-f are parallel to one another and form an angle A with the central axis 498 of between 0–90°.

Figure 10:
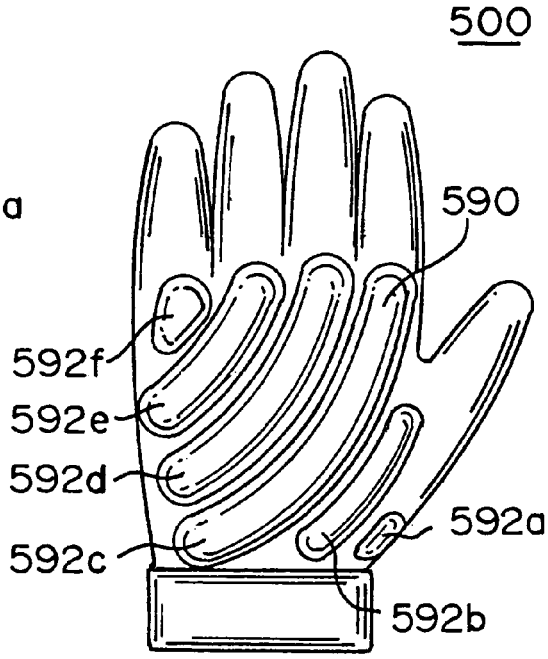
FIG. 10 is a sixth embodiment of the subject invention illustrating a back portion of a glove.

And yet another embodiment FIG. 10 illustrates a glove 500 having back padding 590 comprised of a plurality of strips 592*a–f* which form parallel curved surfaces upon the glove 500.

The strips associated with each of the embodiments discussed herein may have proportions similar to the strip proportions specifically discussed with respect to FIGS. 6 and 11. Additionally, the knuckle pads associated with the embodiment illustrated in FIG. 11 may also be used with the sports gloves in accordance with the other embodiments presented herein.

FIGS. 6, 8, 9 and 10 illustrate gloves having strips which are each oriented in different directions. Since the batter's hand arches about an axis parallel to the hand central axis, (see axis 198 in FIG. 6), and also arches in a direction perpendicular to an axis parallel to the hand central axis, then it is most desirable to orient the strips in a direction angled from both an axis parallel to the hand central axis and an axis perpendicular to the hand central axis. Such desirable configurations are found in FIGS. 9 and 10. When the hand arches, there is a tendency to spread apart the strips illustrated in FIGS. 6 and 8 and, therefore, for these designs the spacing between the strips may be made closer.

What has so far been described is a front pad positioned on the inside of the glove between the index finger and the thumb and a back padding positioned on the outside of the glove protecting the metacarpal portion of the hand.

In yet another embodiment, as illustrated in FIG. 11, knuckle pads 250*a–d* are positioned upon the glove 200 at the location of each of the middle knuckles 37, 47, 57, 67 (FIG. 1) of the index finger 30, middle finger 40, ring finger 50 and small finger 60, respectively, but excluding the thumb. Each of these knuckle pads is constructed in a fashion similar to the back padding 190 illustrated in FIG. 6. Once again, at least one knuckle pad has a length L and a width W, wherein the ratio of the length L to the width W is between 0.7 to 1.5.

As also illustrated in FIG. 11, it is entirely possible to include an additional wrist pad 270 in the region of the wrist 17 (FIG. 1) of the glove 200. While this feature is not illustrated in FIG. 11, such a feature is easily envisioned and may be implemented by one skilled in the art of manufacturing gloves.

The media used in the front pad 180, the back padding 290, 390, 490, 590 and the knuckle pads 250 may be identical and in this fashion the same media is used to dissipate through the front pad 180 vibrators caused by the impact of the ball against the bat and to dissipate the blunt-force impact from a baseball hitting the back padding 290, 390, 490, 590 and or the knuckle pads 250*a–d*. Prior art designs utilize different materials to dissipate vibration from the bat and dissipate the blunt-force impact of a baseball.

What has been described is a vibration dissipating sports glove for use in holding a bat while hitting a baseball which includes a front pad between the index finger and the thumb and, furthermore, may include protection on the back portion of the glove such as a back padding in the metacarpal region of the hand and knuckle pads protecting the middle knuckles of the fingers.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A vibration dissipating sports glove for use in holding a bat while hitting a baseball, wherein portions of the glove correspond to bones in a wearer's hand to which the glove is intended to cover, comprising:

a) a palm portion of the glove, for covering the inner surface of the wearer's hand, exclusive of the thumb;

b) a back portion of the glove for covering the outer surface of a wearer's hand, exclusive of the thumb;

c) a thumb portion of the glove for covering the wearer's thumb, wherein the thumb portion is coupled to the palm portion; and d) a vibration dissipating front pad in the palm portion extending only over and between the proximal knuckles of the thumb, index finger and middle finger and along adjacent portions of the metacarpal bones and proximal phalanges of each of these thumb and fingers, respectively, leaving the remainder of the palm portion unpadded, wherein the energy of the vibration that may be transmitted to the wearer's hand at the time of impact of a baseball with a baseball bat is dissipated by the pad.

2. The glove according to claim 1, wherein the front pad further extends along the index finger metacarpal bone and proximal phalange on index finger distance D and, wherein the front pad extends along the middle finger metacarpal bone and proximal phalange, a middle finger distance E which is no more than ½ the index finger distance.

3. The glove according to claim 1, wherein the pad further extends to the proximal knuckle of the ring finger.

4. The glove according to claim 1, wherein the front pad is generally "T" shaped.

5. The glove according to claim 1, wherein the pad further extends over the proximal phalange of the thumb and terminates before the distal knuckle.

6. The glove according to claim 1, wherein the pad further extends to the proximal knuckle of the ring finger and also extends over the proximal phalange of the thumb and terminates before the distal knuckle.

7. The glove according to claim 1, wherein the pad is filled with an energy dissipating comformable media.

8. The glove according to claim 7, wherein the pad is of sufficient thickness to conform to the bat and to the batter's hand such that any gaps that would naturally occur between the bat and the batter's hand in the region of the pad are minimized thereby providing the batter with a more secure grip.

9. The glove according to claim 7, wherein the media is poly(borosiloxane).

10. The glove according to claim 1, wherein the glove material is nylon and the pad is attached to the nylon and made of leather.

11. The glove according to claim 1, further including back padding at the back portion of the glove covering the region defined by the metacarpal bones of the index finger, middle finger, ring finger and small finger.

12. The glove according to claim 11, wherein both the front pad and the back padding are comprised of energy dissipating conformable media.

13. The glove according to claim 12, wherein the energy dissipating conformable media is (poly)borosiloxane.

14. The glove according to claim 11, wherein the back padding is comprised of a single flat pad.

15. The glove according to claim 11, wherein the back padding is comprised of a plurality of discrete strips each containing energy dissipating conformable media.

16. The glove according to claim 15, wherein each strip has a length and a width and the ratio between the length and width of each strip is between 0.7 and 1.5.

17. The glove according to claim 16, wherein the each strip has a height and the ratio of the height to width of each strip is between 0.25 and 0.50.

18. The glove according to claim 15, wherein each strip has a length and a width and the ratio between the length and width of each strip is between 1.5 to 3.0.

19. The glove according to claim 18, wherein the each strip has a height and the ratio of the width to height of each strip is between 0.5 and 1.0.

20. The glove according to claim 15, wherein the glove has a central axis and the plurality of strips are aligned with the central axis.

21. The glove according to claim 15, wherein the glove has a central axis and the plurality of strips are perpendicular to the central axis.

22. The glove according to claim 15, wherein the glove has a central axis and the plurality of strips parallel to one another and forming an angle with the central axis of between 0–90 degrees.

23. The glove according to claim 15, wherein the plurality of strips form parallel curved surfaces on the glove.

24. The glove according to claim 11, wherein the discrete strips are comprise of media encapsulated in plastic.

25. The glove according to claim 24, wherein the plastic is clear such that the media color is visible.

26. The glove according to claim 24, wherein the plastic is polyurethane.

27. The glove according to claim 11, further including a knuckle pad at the location of each the middle knuckles of each finger, excluding the thumb.

28. The glove according to claim 27, wherein each knuckle pad has a length and a width and the ratio of the length to the width is between 0.7 to 1.5.

29. The glove according to claim 27, wherein the knuckle pads are comprised of energy dissipating conformable media.

30. The glove according to claim 29, wherein the energy dissipating conformable media is (poly)borosiloxane.

31. The glove according to claim 11, wherein the glove further includes a wrist portion and wherein the wrist portion further includes a pad containing an energy dissipating comformable media.

32. A vibration reducing sports glove for use in holding a bat while hitting a baseball, wherein portions of the glove correspond to bones in a wearer's hand to which the glove is intended to cover, comprising:

a) a palm portion of the glove, for covering the inner surface of the wearer's hand, exclusive of the thumb;

b) a back portion of the glove for covering the outer surface of a wearer's hand, exclusive of the thumb;

c) a thumb portion of the glove for covering the wearer's thumb, wherein the thumb portion is coupled to the palm portion;

d) back padding at the back portion of the glove covering the region defined by the metacarpal bones of the index finger, middle finger, ring finger and small finger; and e) a vibration dissipating front pad in the palm portion extending only over and between the proximal knuckles of the thumb, index finger and middle finger and along adjacent portions of the metacarpal bones and proximal phalanges of each of these thumb and fingers, respectively, leaving the remainder of the palm portion unpadded, wherein the energy of the vibration that may be transmitted to the wearer's hand at the time of impact of a baseball with a baseball bat is dissipated by the pad.

33. The glove according to claim 32, wherein the back padding is comprised of a plurality of discrete strips each containing energy dissipating conformable media.

34. The glove according to claim 33, wherein each strip has a length and a width and the ratio between the length and width of each strip is between 0.7 and 1.5.

35. The glove according to claim 32, further including a knuckle pad at the location of each the middle knuckles of each finger, excluding the thumb.

36. The glove according to claim 35, wherein the front pad, back padding and knuckle pads are each comprised of the same energy dissipating conformable media.

37. A vibration dissipating sports glove for use in holding a bat while hitting a baseball, wherein portions of the glove correspond to bones in a wearer's hand to which the glove is intended to cover, comprising:

a) a palm portion of the glove, for covering the inner surface of the wearer's hand, exclusive of the thumb;

b) a back portion of the glove for covering the outer surface of a wearer's hand, exclusive of the thumb;

c) a thumb portion of the glove for covering the wearer's thumb, wherein the thumb portion is coupled to the palm portion; and d) a front pad in the palm portion extending only over and between the proximal knuckles of the thumb, index finger and middle finger and along adjacent portions of the metacarpal bones and proximal phalanges of each of these thumb and fingers, respectively, leaving the remainder of the palm portion unpadded, wherein the front pad is comprised of a conformable media which conforms between the bat and the batter's hand to provide to the batter a more secure grip.

38. The glove in accordance with claim 37, wherein the conformable media is (poly)borosiloxane.

39. The glove in accordance with claim 37, wherein the conformable media is encapsulated by plastic.

40. The glove in accordance with claim 39, wherein the plastic is polyurethane.

* * * * *